US006782770B2

(12) United States Patent
Saito et al.

(10) Patent No.: US 6,782,770 B2
(45) Date of Patent: Aug. 31, 2004

(54) STARTER MOTOR HAVING PLANETARY GEAR DEVICE FOR REDUCING ROTATIONAL SPEED OF ELECTRIC MOTOR

(75) Inventors: Tatsuya Saito, Toyoake (JP); Masahiro Katoh, Chiryu (JP)

(73) Assignee: Denso Corporation, Kariya (JP)

( * ) Notice: Subject to any disclaimer, the term of this patent is extended or adjusted under 35 U.S.C. 154(b) by 74 days.

(21) Appl. No.: 10/194,009

(22) Filed: Jul. 15, 2002

(65) Prior Publication Data

US 2003/0041680 A1 Mar. 6, 2003

(30) Foreign Application Priority Data

Sep. 5, 2001 (JP) ..... 2001-268168

(51) Int. Cl.[7] ..... F02N 15/06
(52) U.S. Cl. ..... 74/7 E; 475/265
(58) Field of Search ..... 74/7 E; 192/56.6; 384/322, 368; 464/46; 475/149, 159, 264, 265, 317

(56) References Cited

U.S. PATENT DOCUMENTS 4,590,811 A * 5/1986 Kasubuchi ..... 74/7 E
4,635,489 A * 1/1987 Imamura et al. ..... 74/7 E
4,739,181 A * 4/1988 Okamoto et al. ..... 290/38 R
4,772,188 A * 9/1988 Kimura et al. ..... 384/368
5,323,663 A 6/1994 Ohgi et al.
6,239,503 B1 * 5/2001 Ikeda et al. ..... 74/7 E

* cited by examiner

*Primary Examiner*—David A. Bucci
*Assistant Examiner*—Timothy McAnulty
(74) *Attorney, Agent, or Firm*—Oliff & Berridge, PLC

(57) ABSTRACT

A starter motor for cranking an internal combustion engine includes an electric motor, a planetary gear device for reducing a rotational speed of the electric motor, and a shock-absorbing device that absorbs excessive impact transmitted from the engine to the starter motor. The planetary gear device has an annular member contacting a separating plate that separates the planetary gear device from the electric motor. A depressed portion such as a circular groove is formed on an axial end surface of the annular member. Lubricant retained in the depressed portion lubricates the end surface that rotates relative to the separating plate to absorb the excessive impact transmitted from the engine, and thereby abrasion wear of the end surface is suppressed.

6 Claims, 4 Drawing Sheets

STARTER MOTOR HAVING PLANETARY GEAR DEVICE FOR REDUCING ROTATIONAL SPEED OF ELECTRIC MOTOR

CROSS-REFERENCE TO RELATED APPLICATION

This application is based upon and claims benefit of priority of Japanese Patent Application No. 2001-268168 filed on Sep. 5, 2001, the content of which is incorporated herein by reference.

BACKGROUND OF THE INVENTION

1. Field of the Invention

The present invention relates to a starter motor for cranking an internal combustion engine, the starter motor having a planetary gear device for reducing a rotational speed of an electric motor.

2. Description of Related Art

An example of conventional starter motors of this kind is disclosed in JP-B2-3158514. The starter motor disclosed therein includes a planetary gear device for reducing a rotational speed of an electric motor and a shock-absorbing device for absorbing an excessive impact applied to the planetary gear device from an internal combustion engine. The planetary gear device includes an annular member, on an inner surface of which an internal gear is formed. The annular member is connected to a rotatable disc of the shock-absorbing device so that the annular member rotates together with the rotatable disc to absorb an excessive impact applied to the starter motor.

The electric motor is separated from the planetary gear device by a separating plate to prevent lubricant supplied to the planetary gear device from flowing into an electric motor chamber. The separating plate also serves to prevent brush dusts of the electric motor from entering into the planetary gear device. The separating plate contacts an axial end surface of a cylindrical portion of the annular member, so that the annular member rotates together with the rotatable disc relative to the separating wall to absorb an excessive impact applied to the starter motor from the internal combustion engine. Because of the relative rotation between the annular member and the separating plate, abrasion wear occurs on the axial end surface of the cylindrical portion. Accordingly, it is highly possible that brush dusts generated in the electric motor chamber enter into the planetary gear device, causing malfunction in gear engagement and generating noises.

SUMMARY OF THE INVENTION

The present invention has been made in view of the above-mentioned problem, and an object of the present invention is to provide an improved starter motor, in which the abrasion between the separating plate and the annular member is suppressed, and thereby the brush dusts are prevented from entering into the planetary gear device.

The starter motor for cranking an internal combustion engine is composed of an electric motor, a planetary gear device, a one-way clutch, an electromagnetic switch. The planetary gear device is composed of a sun gear driven the electric motor, an internal gear and planetary gears engaging with the sun gear and the internal gear. A rotational speed of the electric motor is reduced by the planetary gear device, and a tortational torque is transmitted to an pinion that drives a ring gear of the engine through the one-way clutch. The one-way clutch transmits the rotational torque to the pinion, while intercepting transmission of a rotational torque from the engine to the starter motor. Electric power is supplied to the electric motor through the electromagnetic switch, and the pinion is shifted to a position to engage with the ring gear by a lever driven by the electromagnetic switch. The starter motor also includes a shock-absorbing device that absorbs an excessive impact transmitted from the engine to the starter motor.

The planetary gear device and the shock-absorbing device are housed in a center case and separated from the electric motor by a separating plate. The planetary gear device includes an annular member having a cylindrical portion, on an inner surface of which the internal gear is formed. The annular member made of a material such as resin is inserted into the center case so that the annular member rotates relative to the center case when an excessive impact is transmitted from the engine to the starter motor through the planetary gear device, thereby absorbing the excessive impact. An axial end surface of the cylindrical portion contacts the separating plate. If the axial end surface wears by abrasion with the separating plate, foreign particles such as brush dusts enter the planetary gear device thereby causing malfunction in gear engagement in the planetary gear device and generating harmful noises.

In order to suppress the abrasion wear of the axial end surface of the cylindrical portion, a depressed portion in which lubricant supplied to the planetary gear device is retained is formed on the axial end surface. The axial end surface rotatable relative to the separating plate is properly lubricated by the lubricant retained in the depressed portion, and thereby the abrasion wear is suppressed. The depressed portion also serves to keep the foreign particles therein to prevent them from entering into the planetary gear device.

The depressed portion may be variously shaped. It may be a continuous circular groove or more than two circular grooves formed coaxially to one another. The circular groove may include widened portions to retain more lubricant therein. A continuous groove may be made along an outline of the internal gear teeth. Plural discrete grooves may be formed on the axial end surface. The depressed portion or the groove may be formed on the separating plate in an area contacting the axial end surface instead of forming it on the axial end surface.

According to the present invention, the abrasion wear of the axial end surface of the cylindrical portion are suppressed by the lubricant retained in the depressed portion, and thereby foreign particles such as brush dusts are prevented from entering the planetary gear device.

Other objects and features of the present invention will become more readily apparent from a better understanding of the preferred embodiment described below with reference to the following drawings.

DETAILED DESCRIPTION OF THE PREFERRED EMBODIMENT

Figure 1:
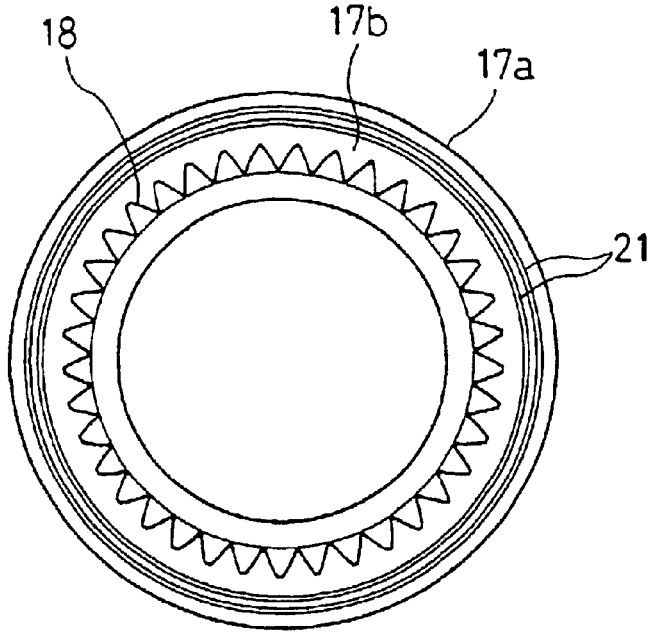
FIG. 1 is a plan view showing an axial end surface of a cylindrical portion on which two circular grooves are formed.

An embodiment of the present invention will be described with reference to FIGS. 1–3. First referring to FIG. 2, an entire structure of a starter motor according to the present invention will be described. A starter motor 1 is composed of an electric motor 2, a pinion 3 driven by the electric motor 2, an electromagnetic switch 6 for shifting forward the pinion 3 and for closing contacts of the electric motor 2, and other associated components. An rotational torque of the electric motor 2 is transmitted to the pinion 3 through a planetary gear device for reducing a rotational speed of the electric motor 2. The pinion 3 engages with a ring gear 4 of an internal combustion engine to crank up the engine. The starter motor also includes a shock-absorbing device for absorbing an excessive impact transmitted from the engine to the starter motor 1.

The electric motor 2 is a known type of a direct current electric motor. Upon turning on an ignition switch, electric power is supplied to a coil (not shown) contained in the electromagnetic switch 6. Electric contacts (not shown) contained in the electromagnetic switch 6 are closed thereby to supply electric power to an armature 8 of the electric motor 2 through brushes 7. At the same time, a plunger connected to a lever 9 is pulled in by the coil thereby to push out a one-way clutch 10. The one-way clutch 10 is coupled to an output shaft 5 via a helical spline formed on the output shaft 5. The one-way clutch 10 transmits a rotational torque of the output shaft 5 to the pinion 3, and intercepts torque transmission from the pinion 3 to the output shaft 5 when a rotational speed of the pinion 3 exceeds that of the output shaft 5. The pinion 3 formed integrally with an inner member 10*a* of the one-way clutch 10 is slidably coupled to the output shaft 5 via a bearing 11.

The output shaft 5 is disposed coaxially with an armature shaft 8*a*. One end of the output shaft 5 is rotatably supported by a front housing 13 via a bearing 12, and the other end of the output shaft 5 is rotatably supported by a center case 15 via a bearing 14 (shown in FIG. 3). The center case 15 held between the front housing 13 and a yoke 2*a* covers the planetary gear device and the shock-absorbing device.

Figure 3:
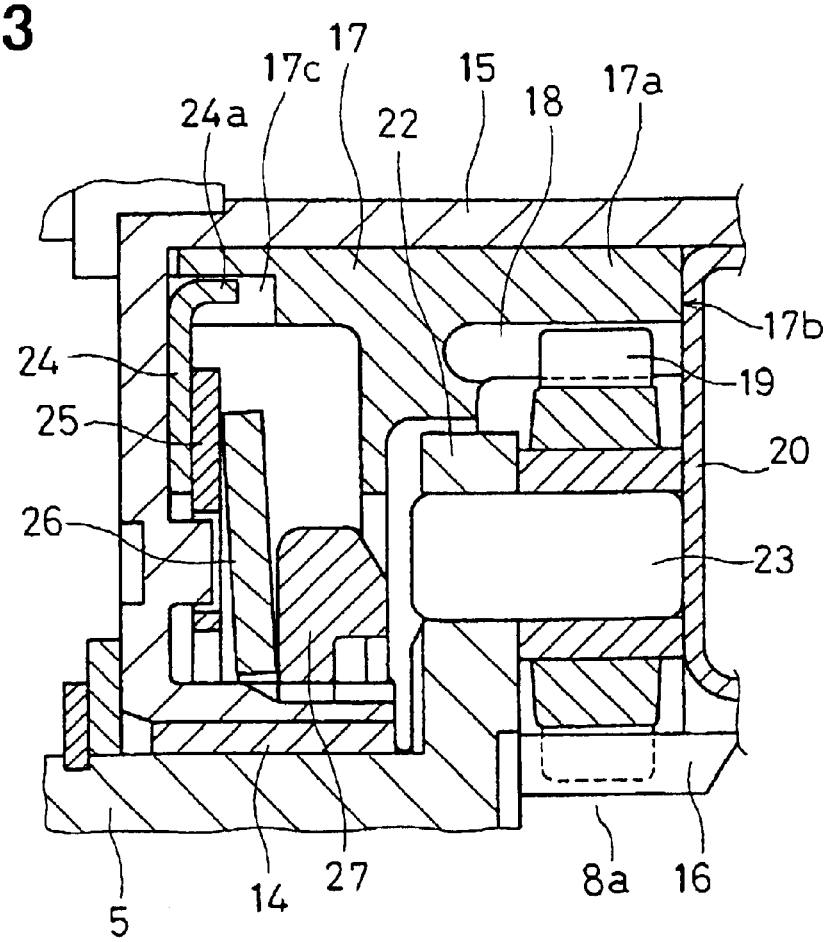
FIG. 3 is a cross-sectional view showing a shock-absorbing device and a planetary gear device, both housed in a center case of the starter motor.

FIG. 3 shows the planetary gear device and the shock-absorbing device covered by the center case 15. The planetary gear device is composed of a sun gear 16 formed on the armature shaft 8*a*, an internal gear 18 formed on an inner surface of an annular member 17 (described later in detail), and planetary gears 19 engaging with both the sun gear 16 and the internal gear 18. The planetary gear device is disposed in the center housing 15 and separated from the electric motor 2 by a separating plate 20, as shown in FIG. 2.

The annular member 17 is made of a material such as resin and disposed in the center case 15, so that the annular member 17 rotates relative to the center case 15 when an excessive force is applied thereto from the engine. The annular member 17 has a cylindrical portion 17*a* extending in the axial direction. The internal gear 18 is formed on an inner surface of the cylindrical portion 17*a*. On an axial end surface 17*b* of the cylindrical portion 17*a*, two circular grooves 21 are formed, as shown in FIG. 1. Three or more circular grooves 21 may be formed on the axial end surface 17*b*.

When the sun gear 16 is rotated by rotation of the armature 8, the planetary gears 19 engaging with the sun gear 16 and internal gear 18 rotate around a pin 23 that supports each planetary gear 19. The pin 23 is fixedly supported by a flange-shaped carrier 22 which is integrally formed with the output shaft 5. The flange-shaped carrier 22 carrying the planetary gears 19 thereon rotates around the sun gear 16 as the planetary gears 19 rotate around the respective pins 23. Thus, the rotation of the armature 8 is transmitted to the output shaft 5 via the planetary gear device. The rotational speed of the armature 8 is reduced by the planetary gear device with a certain reduction ratio determined by the structure of the planetary gear device.

The shock-absorbing device, as shown in FIG. 3, is composed of a rotatable disc 24 (abrasion plate), a stationary disc 25, a disc spring 26 and an adjusting screw 27. When an excessive impact is applied to the starter motor 1 from the engine, the rotatable disc 24 rotates against a abrasive force applied thereto, thereby absorbing the impact. The rotatable disc 24 is made of a plate such as a metallic plate and has a plural projections formed on both surfaces thereof. The surfaces having the projections serve as a frictional or abrasive surface. The rotatable disc 24 is sandwiched between a front wall of the center case 15 and the stationary disc 25. A craw portion 24*a* formed around an outer periphery of the rotatable disc 24 is inserted into a cut-out 17*c* formed on the annular member 17 and fixedly connected to the annular member 17.

Now, operation of the starter motor 1 described above will be explained. Upon turning on the ignition switch, the plunger of the electromagnetic switch 6 is pulled in by an electromagnetic force generated by the coil. The one-way clutch 10 is pushed forward together with the pinion 3, sliding on the output shaft 5, by the lever 9 driven by the plunger. The pinion 3 abuts a side surface of the ring gear 4. As the plunger is further pulled in, the contacts contained in the electromagnetic switch 6 are closed thereby to supply electric power to the armature 8. The rotational speed of the armature 8 is reduced by the planetary gear device, and the rotational torque of the armature 8 is transmitted to the output shaft 5. The rotation of the output shaft 5 is transmitted to the pinion 3 via the one-way clutch 10. The pinion 3 engages with the ring gear 4 when the pinion 3 rotates to a position where engagement becomes possible. Thus, the rotational torque of the pinion 3 is transmitted to the ring gear 4, and thereby the engine is cranked up.

If an excessive impact (a rotational torque) due to a pulsating torque of the engine is applied to the starter motor 1 during a cranking operation, the impact is transmitted to the annular member 17 via the internal gear 18 engaging with the planetary gears 19. The impact is further transmitted from the annular member 17 to the rotatable disc 24 which is connected to the annular member 17. If the rotational torque due to the impact exceeds a frictional force applied to the rotatable disc 24 to keep its position, the rotatable disc 24 rotates against the frictional force. Thus, the excessive impact applied from the engine to the starter motor 1 is absorbed.

Upon turning off the ignition switch, power supply to the coil in the electromagnetic switch 6 is terminated. The plunger pulled in by the coil returns to its original position. The pinion 3 is separated from the ring gear 4 and returns to its original position together with the one-way clutch 10, sliding on the output shaft 5. At the same time, the contacts for supplying electric power to the armature 8 are opened, thereby stopping rotation of the armature 8.

Following advantages are attained by the present invention. Lubricant contained inside the annular member 17 splashes according to rotation of the planetary gears 19. The splashed lubricant is retained in the circular grooves 21 formed on the axial end surface 17*b* of the cylindrical portion 17*a*. Abrasion between the axial end surface 17*b* and the separating plate 20, which occurs when the annular member 17 is rotated to absorb an excessive impact applied from the engine to the starter motor 1, is alleviated by the lubricant retained in the circular grooves 21, and the lubricant is attached to the axial end surface 17*b* and a surface of the separating plate 20 contacting the axial end surface 17*b*.

Figure 2:
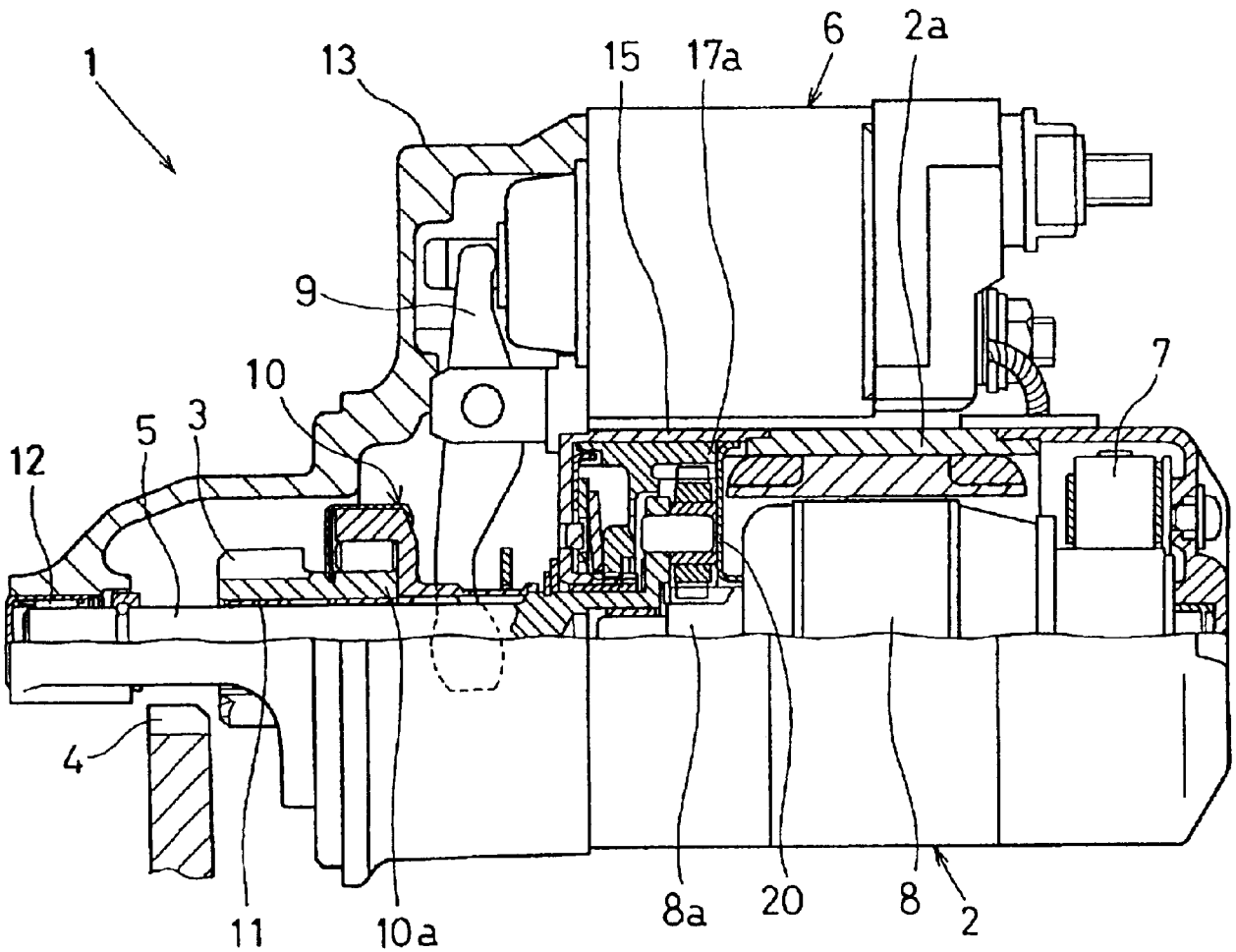
FIG. 2 is a side view, partially cross-sectioned, showing an entire structure of a starter motor.
Figure 4:
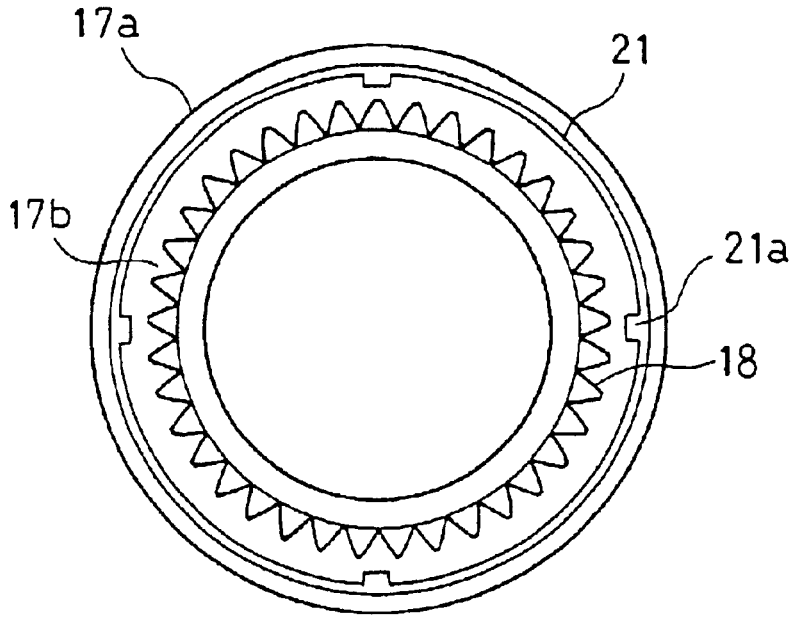
FIG. 4 is a plan view showing an axial end surface of a cylindrical portion:on which a circular groove having widened portions is formed.

Two circular grooves 21 are formed as shown in FIG. 1, i.e., an outer circular groove is formed to surround an inner circular groove. If foreign particles such as brush dusts enter into the contacting portion between the axial end surface 17*b* and the separating plate 20, the foreign particles can be retained in either one of the circular grooves 21. Accordingly, harmful noises caused by the foreign particles entered into the planetary gear spaces are effectively prevented.

Figure 5:
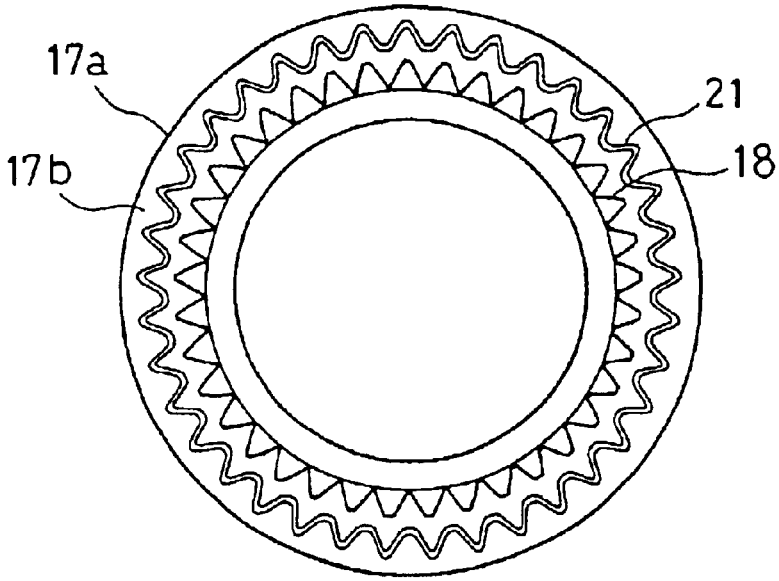
FIG. 5 is a plan view showing an axial end surface of a cylindrical portion on which a zigzag groove is formed along teeth of an internal gear.
Figure 6:
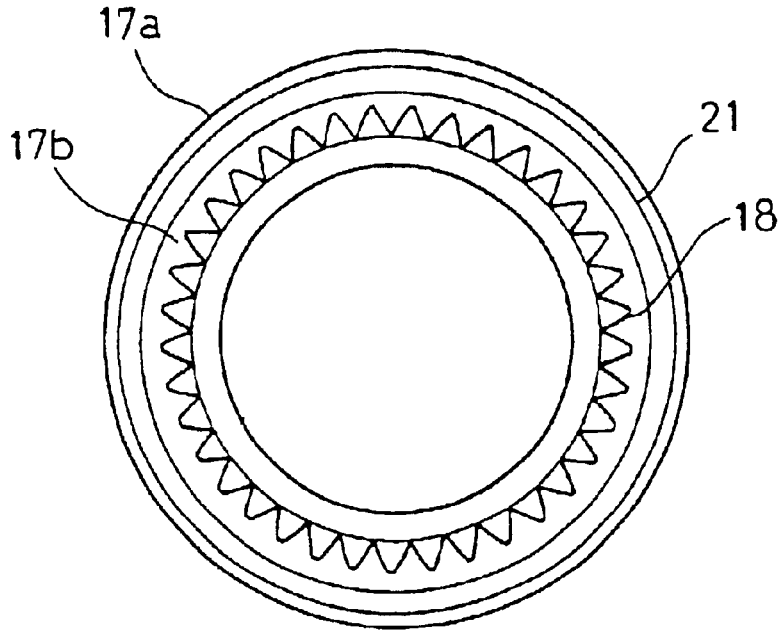
FIG. 6 is a plan view showing an axial end surface of a cylindrical portion on which a relatively wide circular groove is formed.
Figure 7:
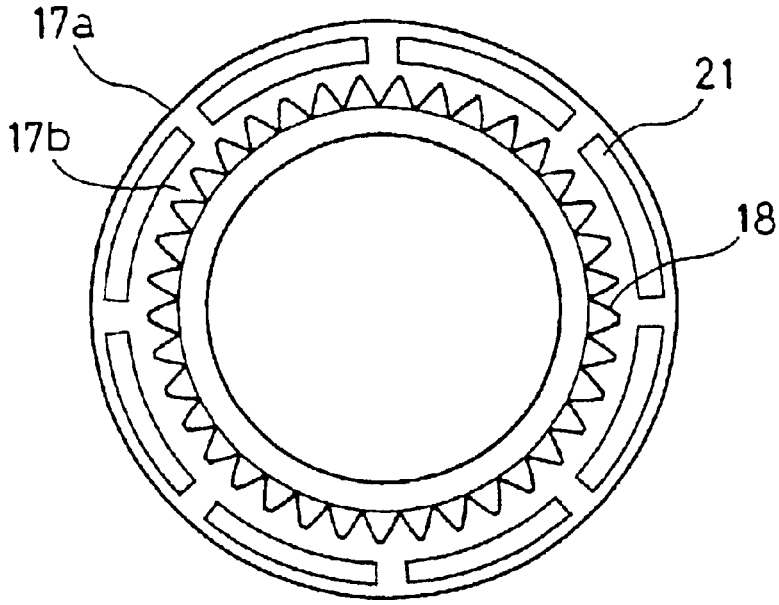
FIG. 7 is a plan view showing an axial end surface of a cylindrical portion on which a plurality of discrete grooves are formed.

The form of the circular grooves 21 shown in FIG. 1 may be modified in various ways. FIGS. 4–7 show modified forms of the grooves. The circular groove 21 shown in FIG. 4 has four widened portions 21*a*. The widened portion 21*a* is made at least one position on the circular groove 21, or may be made at more than two positions. A larger amount of the lubricant can be retained in the widened portions 21*a*. The groove 21 shown in FIG. 5 is formed in a zigzag shape along an outline of teeth of the internal gear 18. Since the zigzag-shaped groove 21 is parallel to the outline of the internal gear teeth, mechanical strength of the teeth is not decreased by making the groove. The groove 21 shown in FIG. 6 has a wider width than that of the groove shown in FIG. 1. It is preferable to make the groove width around one-third of a total width of the axial end surface 17*b* including the height of the internal gear teeth. By making the groove wider, the axial end surface 17*b* and the contacting surface of the separating plate 20 can be thoroughly lubricated. In a modification shown in FIG. 7, a plurality of discrete grooves 21 are formed on the axial end surface 17*b*. The plural discrete grooves can attain similar effects as the continuous circular groove.

Though the groove or grooves 21 are formed on the axial end surface 17*b* in the foregoing embodiment including modifications, it is possible to form the groove or grooves on the surface of the separating plate 20 contacting the axial end surface 17*b*. A groove or grooves performing a similar function may be formed on other surfaces making a relative rotation.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter motor, comprising:

an electric motor;

a planetary gear device for reducing a rotational speed of the electric motor, the planetary gear device including an annular member having a cylindrical portion that has an internal gear formed on an inner surface thereof;

a separating plate separating the planetary gear device from the electric motor and contacting an axial end surface of the cylindrical portion;

a depressed portion for retaining lubricant therein, the depressed portion being formed on the axial end surface of the cylindrical portion; and a shock-absorbing device including a rotatable disc connected to the annular member, wherein the rotatable disc rotates together with the annular member that rotates relative to the separating plate when an excessive rotational torque exceeding a predetermined level is applied to the planetary gear device, thereby absorbing the excessive rotational torque.

2. The starter motor as in claim 1, wherein the depressed portion consists of a plurality of continuous circular grooves formed coaxially to one another.

3. The starter motor as in claim 1, wherein the depressed portion is a continuous circular groove having widened portions.

4. The starter motor as in claim 1, wherein the depressed portion is a continuous circular groove, the width of which is about one-third of a total width of the axial end surface of the cylindrical portion including a height of the internal gear.

5. The starter motor as in claim 1, wherein the depressed portion is a continuous zigzag groove formed along and in parallel to an outline of the internal gear.

6. A starter motor, comprising:

an electric motor;

a planetary gear device for reducing a rotational speed of the electric motor, the planetary gear device including an annular member having a cylindrical portion that has an internal gear formed on an inner surface thereof;

a separating plate separating the planetary gear device from the electric motor and contacting an axial end surface of the cylindrical portion;

a depressed portion for retaining lubricant therein, the depressed portion being formed on the axial end surface of the cylindrical portion, the depressed portion including a plurality of discrete grooves separated from one another; and a shock-absorbing device including a rotatable disc connected to the annular member, wherein the rotatable disc rotates together with the annular member that rotates relative to the separating plate when an excessive rotational torque exceeding a predetermined level is applied to the planetary gear device, thereby absorbing the excessive rotational torque.

* * * * *